US005083965A

United States Patent [19]

Mayem

[11] Patent Number: 5,083,965

[45] Date of Patent: Jan. 28, 1992

[54] INTERACTIVE DOLL SYSTEM

[75] Inventor: Leonard M. Mayem, Irvine, Calif.

[73] Assignee: Catalina Toys, Inc., Newport Beach, Calif.

[21] Appl. No.: 475,719

[22] Filed: Feb. 6, 1990

[51] Int. Cl.[5] ..... A63H 3/24; A63H 3/28; A63H 29/22

[52] U.S. Cl. ..... 446/305; 446/306; 446/297; 446/302; 446/484

[58] Field of Search ..... 446/268, 270, 295, 296, 446/297, 298, 299, 302, 303, 304, 305, 306, 484, 190; 434/266

[56] References Cited

U.S. PATENT DOCUMENTS

| | | | |
|---|---|---|---|
| 2,080,439 | 5/1937 | Schaeffer | 446/305 |
| 2,907,139 | 10/1959 | Rekettye | 446/305 |
| 2,978,833 | 4/1961 | Tancredi | 446/305 |
| 3,758,983 | 9/1973 | Cagen | 446/306 |
| 4,160,338 | 7/1979 | Lyons et al. | 446/305 X |
| 4,249,338 | 2/1981 | Wexler | 446/297 X |
| 4,696,653 | 9/1987 | McKeefery | 446/303 X |
| 4,857,030 | 8/1989 | Rose | 446/303 |

FOREIGN PATENT DOCUMENTS

| | | | |
|---|---|---|---|
| 588684 | 12/1959 | Canada | 446/305 |
| 2758371 | 7/1978 | Fed. Rep. of Germany | 446/297 |
| 2068753 | 8/1981 | United Kingdom | 446/305 |

*Primary Examiner*—Robert A. Hafer
*Assistant Examiner*—D. Neal Muir
*Attorney, Agent, or Firm*—Christie, Parker & Hale

[57] ABSTRACT

An interactive doll system incorporates both liquid handling elements for receiving liquid through the mouth of the doll when the doll is in a first range of positions, then dispensing that liquid through the eyes of the doll when the doll is in a second range of positions or through an anal opening of the doll when the doll is in a third range of positions. It also incorporates an electronic assembly for sensing the attitude and motion of the doll, as well as feeding of the doll, and for producing a range of sounds in response thereto, including sounds produced randomly at times in response to motion of the doll.

8 Claims, 6 Drawing Sheets

Vcc
+6V
70
74
Vcc
Vss
RESET
I2
72
I5
Q1
I6
Q3
Q2
MOTB
I0
92
90
Q0
OSCE
UD
I4
X1
X2
DND
I3
124
A01
BOTTLE
I1
A02
104
104
BOTTLE SWITCH

INTERACTIVE DOLL SYSTEM

BACKGROUND OF THE INVENTION

The present invention relates to a doll that incorporates means for simulating both sounds and the bodily functions of an infant, these means being position sensitive to both interact with a child in a realistic manner and to produce occasional sounds to initiate such interaction.

For centuries dolls have been popular playthings for children. In their most primitive form, they have simply simulated the appearance of a person, typically an infant. As they have evolved, this simulation has become ever more realistic. In recent times, dolls have been designed which incorporate means to accept liquid into the doll, and to discharge liquid from adjacent the doll's eyes to simulate crying as well as to discharge liquid from the anal area to simulate wetting. Other dolls also have been designed to produce a variety of noises. Customarily, these dolls allow the child to initiate the interaction; the child must do something to cause the doll to make sounds, or to cry, or to wet its diaper.

In play, it is desirable to stimulate a child's imagination by having the toy or other plaything occasionally initiate an interaction. It would be desirable to provide a doll that interacted with a child in a realistic fashion, at times calling the child for attention, at other times responding to a child's actions on the doll. It would also be highly desirable to provide a doll incorporating such interactive capabilities that is of a size appropriate to a child, that is simple and durable in construction, that offers a variety of interactive options, and that does not require regular attention and servicing by an adult.

These and other objects of the present invention will be apparent to those skilled in this art from the following description of a preferred embodiment of an interactive doll system.

BRIEF SUMMARY OF THE INVENTION

The invention contemplates an interactive doll system that incorporates both liquid handling elements and electronic elements, both being responsive to the position of the doll, the electronic elements also being responsive to certain features of the liquid handling elements of the doll.

More particularly, the preferred construction of doll has, in combination, a hollow body and a hollow head with eyes and an open mouth therein. Reservoirs are provided within the head and body. The head also includes position sensitive feeding means for conducting liquid from the doll's open mouth to the head reservoir only when the doll is oriented in a first range of positions. Preferably the doll includes position sensitive weeping or tearing means for conducting liquid from the head reservoir to the eyes only when the doll is oriented in a second range of positions different from the first range of positions.

The doll also includes a body reservoir for liquid. Position sensitive means are provided to conduct liquid from the head reservoir to the body reservoir only when the doll is oriented in a third range of positions different from the first and second ranges. Also, position sensitive wetting means are provided to conduct liquid from the body reservoir to an anal opening in the doll's body only when the doll is oriented in a certain range of positions.

The electronic elements of the doll preferably include, mounted within the doll, means for producing random infant noises and, in response to a certain sequence of doll actions, for producing crying sounds. More particularly, means are provided to sense application of liquid to the feeding means and to inhibit the crying sounds of the electronic means. Further means are provided to sense cessation of the application of liquid to the feeding means and for then inducing production of crying sounds by the electronic means if the doll is placed in a certain range of positions. Also, preferably motion sensitive means are provided for further controlling the production of sounds by the electronic means, including production of sounds to initiate interactions with the child during play.

Additional features of the doll will be apparent from the following detailed description of a preferred embodiment of the doll.

BRIEF DESCRIPTION OF THE DRAWINGS

The invention will be further described in connection with the accompanying drawings in which.

DETAILED DESCRIPTION

The preferred construction of the interactive doll system of the present invention offers the child a wide range of playing opportunities. The child is not required to always initiate some action by the doll; on occasion the doll will take the initiative to, for example, call the child or to initiate some other interaction with the child. Thus, the preferred construction of doll provided by the present invention offers a wide range of playing experiences to the child.

Figure 1:
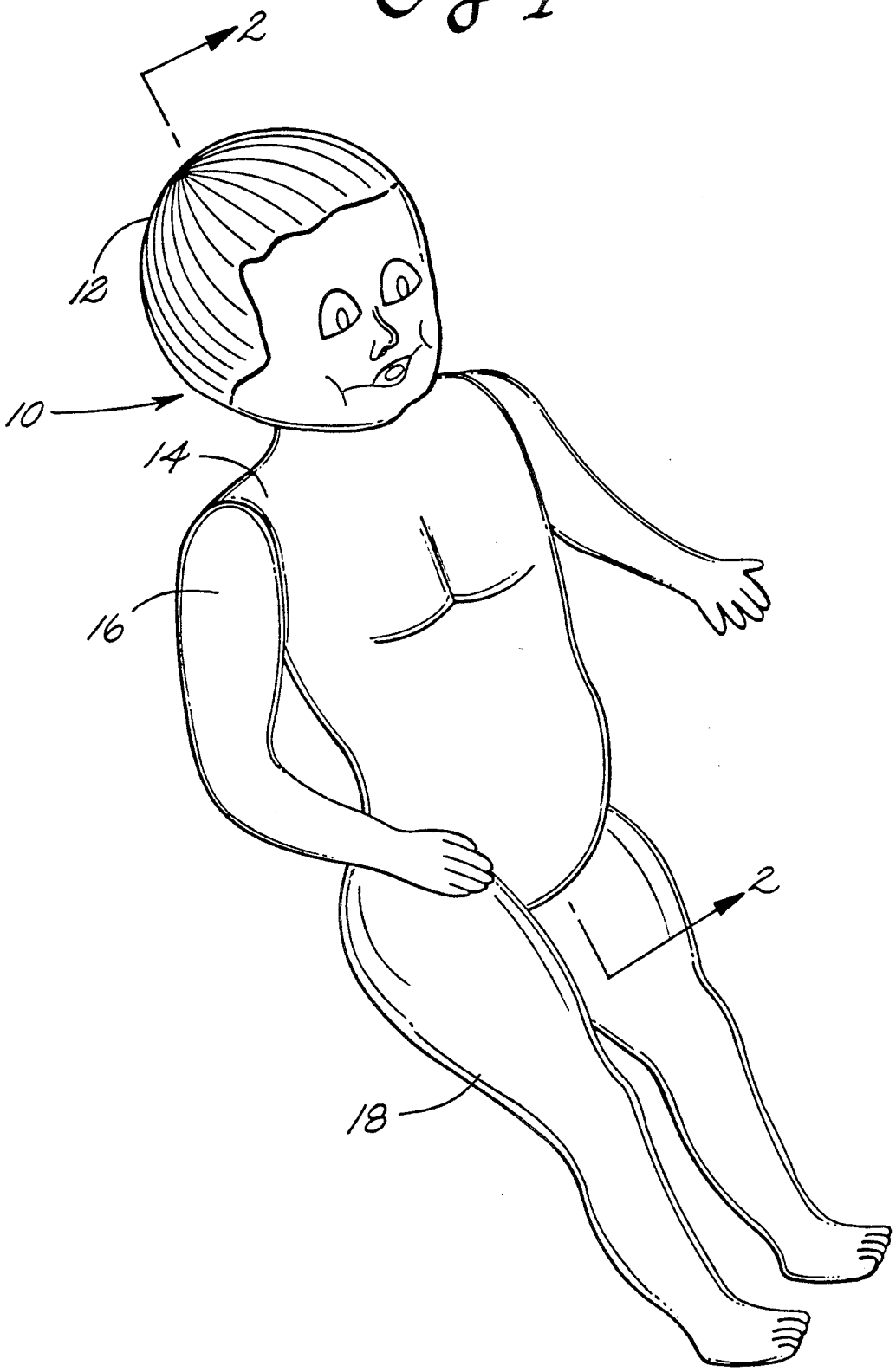
FIG. 1 is a perspective view of a doll constructed in accordance with the teachings of the present invention.

As shown in FIG. 1, the preferred construction of the interactive doll system is fairly ordinary in external appearance, simulating the general appearance of a human infant. The body of the doll includes a the head 12, a torso 14, arms 16, and legs 18. They are each formed of a pliable, resilient, skin-like material such as any of various plastics. The various body elements of the doll interlock with one another in a conventional fashion to form a doll as shown in FIG. 1.

Figure 2:
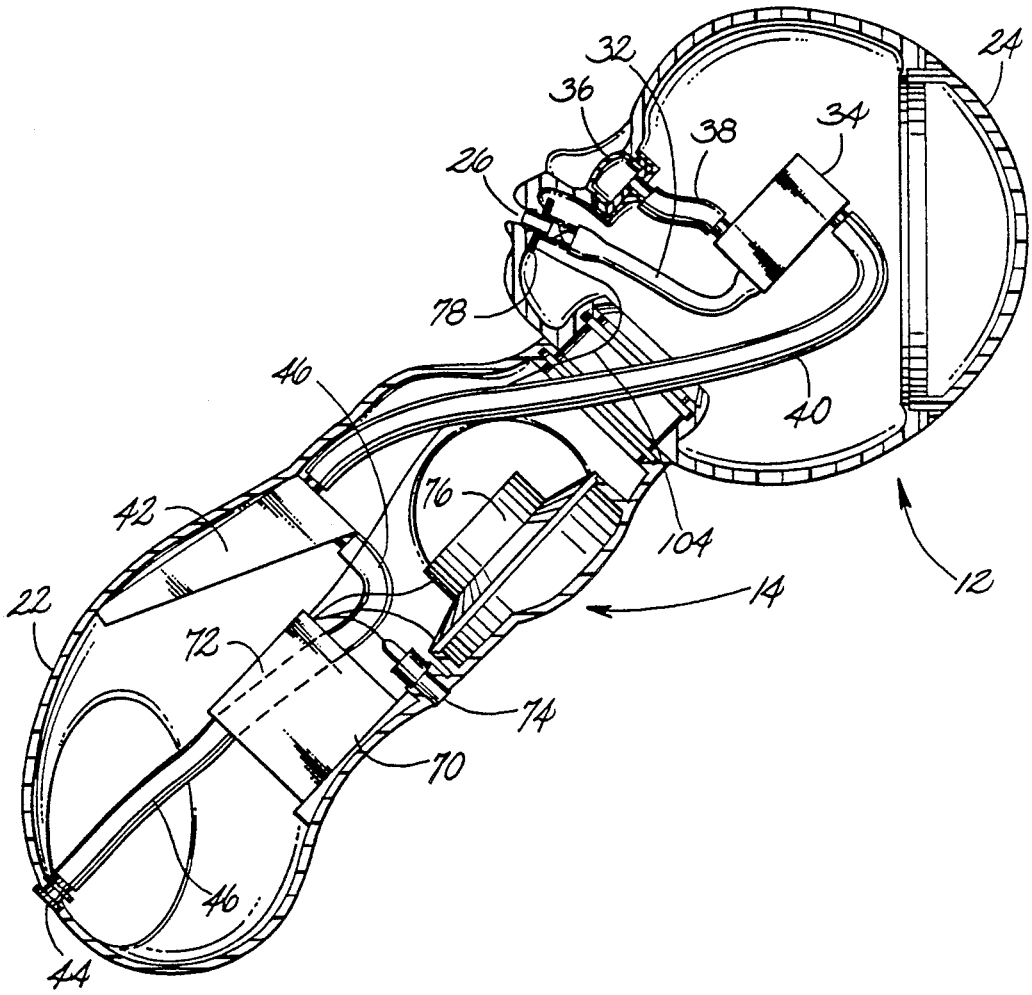
FIG. 2 is a cross-sectional side view of the head and torso portion of the doll shown in FIG. 1, taken on lines II—II.

A vertical cross-section of a preferred construction of the head 12 and torso 14 of the doll of the present invention is shown in FIG. 2. It well illustrates the liquid handling elements incorporated within the doll. These liquid handling elements are interrelated in a fashion to be described herein such that certain actions are permitted only while the doll is oriented within a particular range of positions. In general, this range of positions is defined by relating the longitudinal axis of the doll—the axis extending from the base of the torso 22 to the top of the head 24—to the horizontal plane. When the doll is laying on its back facing up it is said to be at 0 degrees—its longitudinal axis lies in the horizontal plane —while when the doll is standing up it is at 90 degrees and when it is laying face down it is at a 180 degree position.

Figure 3:
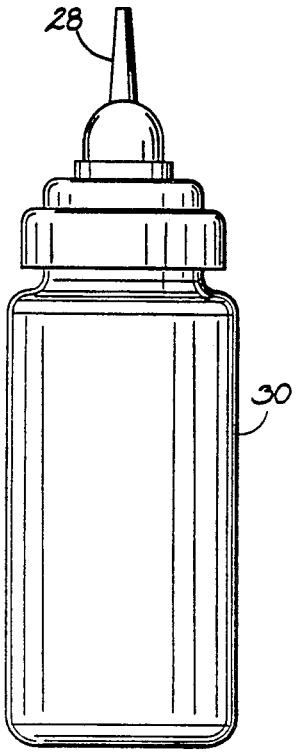
FIG. 3 is a view of a bottle appropriate for feeding the doll of the present invention.

The head 12 of the doll includes a partially opened mouth 26 that may receive liquid such as from the nipple 28 of a bottle 30 (shown in FIG. 3). Tubing 32 conducts that liquid to a head reservoir 34 that is appropriately mounted within the head 12 of the doll in the orientation illustrated in FIG. 2. Extending from the head reservoir to an eye structure 36 is a piece of tubing 38. Extending from the head reservoir down through the neck and into the body 14 of the doll is tubing 40; it attaches to a torso reservoir 42 appropriately mounted within the body generally in the orientation illustrated in FIG. 2. Extending from torso reservoir 42 to an anal opening 44 is a length of tubing 46. Thus, by this plumbing, liquid fed to the doll through mouth 26 is held within reservoir 34 and may pass either to the eye structure 36, to simulate crying, or to the torso reservoir 42 and then from the torso reservoir to the anal opening 44 to simulate wetting.

In the preferred construction, these liquid processing functions and interactions are all position sensitive. In part, this is achieved by the construction of the head reservoir 34 and the torso reservoir 42; in part it is achieved by the orientations of these reservoirs relative to one another and within the doll.

Figure 5:
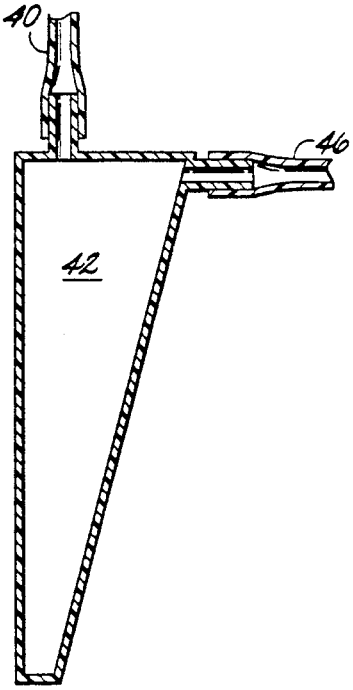
FIG. 5 is a view in vertical cross-section of the torso reservoir included in the preferred doll construction.
Figure 4:
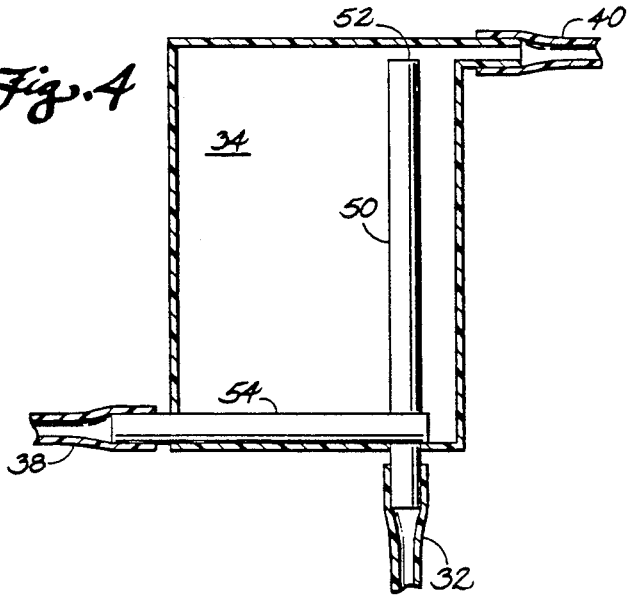
FIG. 4 is a vertical cross-sectional view of the head reservoir of the doll.

The head reservoir 34 is shown generally in cross-section in FIG. 4; the torso reservoir shown generally in cross-section in FIG. 5. The head reservoir preferably is sized to hold within it approximately 15 cc of water; the torso reservoir is sized to preferably hold within it approximately 10 cc of water. This liquid is fed from the bottle's nipple 28 to the mouth opening 26 of the doll, and then through tubing 32 to the head reservoir where it discharges through tube 50, the inner opening of this tube being positioned generally adjacent to the far wall of the reservoir as shown in FIG. 4. Since liquid will naturally only flow downhill, it is necessary for the inner opening 52 of tube 50 to be horizontally beneath mouth opening 26 for the head reservoir to fill. By virtue of the location and orientation of the head reservoir relative to the mouth of the doll, this in turn means that the doll must be at an angle of approximately less than 35 degrees above the horizontal, and facing up.

As previously described, tubing 40 conducts liquid from the head reservoir 34 to the torso reservoir 42. The inlet of tubing 40 is positioned adjacent the top corner of the head reservoir. If, for example, the doll is tilted during feeding such that its head is at an angle of substantially less than 20 degrees above the horizontal, liquid will flow from opening 52 of tube 50 within the head reservoir into tube 40 to at least partially fill that tube. Since the torso reservoir 42 will, in this orientation of the doll, be above head reservoir 34, the liquid will only partially fill tube 40; it will not begin flowing into the torso reservoir 42 while the doll is in this orientation. If however the doll is positioned between about 20 degrees and 35 degrees, then both the head reservoir 34 and the torso reservoir 42 may be filled by feeding the doll water through its mouth 26. In summary, the doll of the preferred construction of the present invention is constructed to receive approximately 15 cc of liquid into head reservoir 34 and 10 cc of water in the torso reservoir 42 when the nipple of bottle 30 is placed within mouth 26 and the orientation of the doll is substantially between 20 degrees and 35 degrees.

Should the doll, after being "fed" with liquid, be tipped up such that tube 54 lying adjacent the bottom wall of head reservoir 34 receive liquid, that liquid will flow through tubing 38 to the eye structures 36. However, such flowage from the head reservoir to the eyes is also controlled by the position of the doll. Specifically, such flowage will only occur when the doll is oriented above approximately 70 degrees to 75 degrees; in that orientation the discharge of tube 54 in the head reservoir will be above the inlet to the eye structure 36 thereby allowing liquid to flow through tubing 38. This flowage will be permitted to continue as the doll tips forward until, preferably, it reaches an angle of approximately 160 degrees, the flowage at any greater angle being prevented by virtue of the inlet to tube 54 being adjacent the back wall of head reservoir 34 as shown in FIG. 4.

Figure 6:
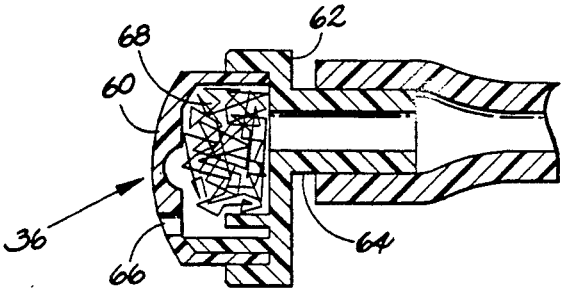
FIG. 6 is a view in vertical cross-section of a preferred eye construction of the doll.

The preferred eye structure is shown in FIG. 6. It includes a pupil element 60 received in a socket 62, the socket having a tubular extension 64 for receiving the end of tubing 38. The pupil element is constructed generally as a cup to provide a hollow interior for receiving approximately 5 cc of liquid. It also includes a lower orifice 66 to permit this liquid to flow from the interior of the eye, the orifice being positioned to cause the liquid to well up on the eyelids of the doll and to drop down over the doll's cheeks in a fashion normal for tears. It may also have an upper orifice which will allow water to flow over the pupil of the eye. Preferably the surface of the eye in hydrophilic. Since the unobstructed flow of this liquid may result in too rapid a tearing action, or too great a flow of tears, it is preferred to provide within the interior chamber 68 of pupil element 60 means to obstruct the flow of liquid through the eye, which means may be, for example, a porous foam element or a piece of cotton wadding or rope.

The preferred construction of the torso reservoir is shown in FIG. 5. When the head reservoir 34 has been at least partially filled through tubing 32, as previously described, liquid will be permitted to flow through tubing 40 to torso reservoir 42 when the doll is tipped to be oriented such that the inlet tubing 40 is beneath the liquid level within the head reservoir and above the outlet of tubing 40 into the torso reservoir 42. This will normally occur as the doll is being fed, for in the feeding orientation—i.e. between about 20 degrees and 35 degrees—liquid will flow into the inlet of tubing 40, and then into the torso reservoir to fill that reservoir.

Bottle 30 is sized such that the amount of liquid it will dispense is sufficient to substantially fill both the head reservoir and the torso reservoir. The torso reservoir will not dispense liquid into tubing 46, however, until the doll is tilted back towards the horizontal, such that its longitudinal axis lies below about 20 degrees but no less than about 0 degrees, or face up and in line with the horizontal plane. In this orientation, the inlet to tubing 46 from torso reservoir 42 will be above the anal opening 44 to allow water to flow down the tubing and out opening 44; however, if the doll is tipped back beyond the horizontal, with its head down such that its longitudinal axis lies for example at an orientation of about 350 degrees, the inlet to tubing 46 will be beneath outlet 44; thus water will not flow out the anal opening but rather will flow from the torso reservoir 42 back to the head reservoir 34.

In summary, when the doll is in an orientation of from about 25 degrees to 35 degrees it may be "fed" liquid to charge head reservoir 34 and torso reservoir 42; when the doll is tipped up to an orientation between 75 degrees and 160 degrees liquid will flow from the head reservoir 34 out eyes 36 to simulate tearing; when the doll is tipped back to lie between about 20 degrees and 0 degrees liquid will flow from the torso reservoir out the anal opening to simulate wetting. Thus, by providing and properly constructing both a head reservoir and a torso reservoir, and by properly orienting these reservoirs relative to one another and to the various noted elements of the doll, a position sensitive liquid receiving and dispensing structure is provided to receive liquid and charge the reservoirs in a feeding orientation, and then to dispense tears in a crying orientation or to cause the doll to wet in a different orientation.

Figure 7:
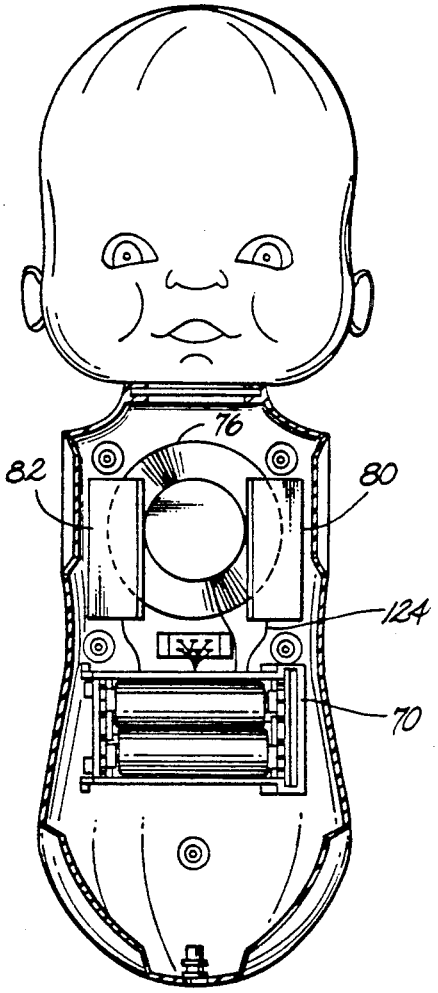
FIG. 7 is a front view, partially in cross-section, of the head and torso of the preferred doll showing the electronic means mounted therein.

The interactive doll system of the present invention also incorporates various electronic elements to enhance its interaction with a child. Specifically, as shown for example in FIGS. 2 and 7 the doll has mounted within its torso a battery compartment 70 that has, attached to its interior base, a sealed electronic circuit assembly 72. This circuit assembly is connected to an on/off switch 74, a speaker 76, a mouth switch 78, an attitude switch 80 and a motion switch 82. These various elements, for the most part, mount to upstanding posts or walls formed on the interior of the hollow torso of the doll, generally as shown.

Figure 8:
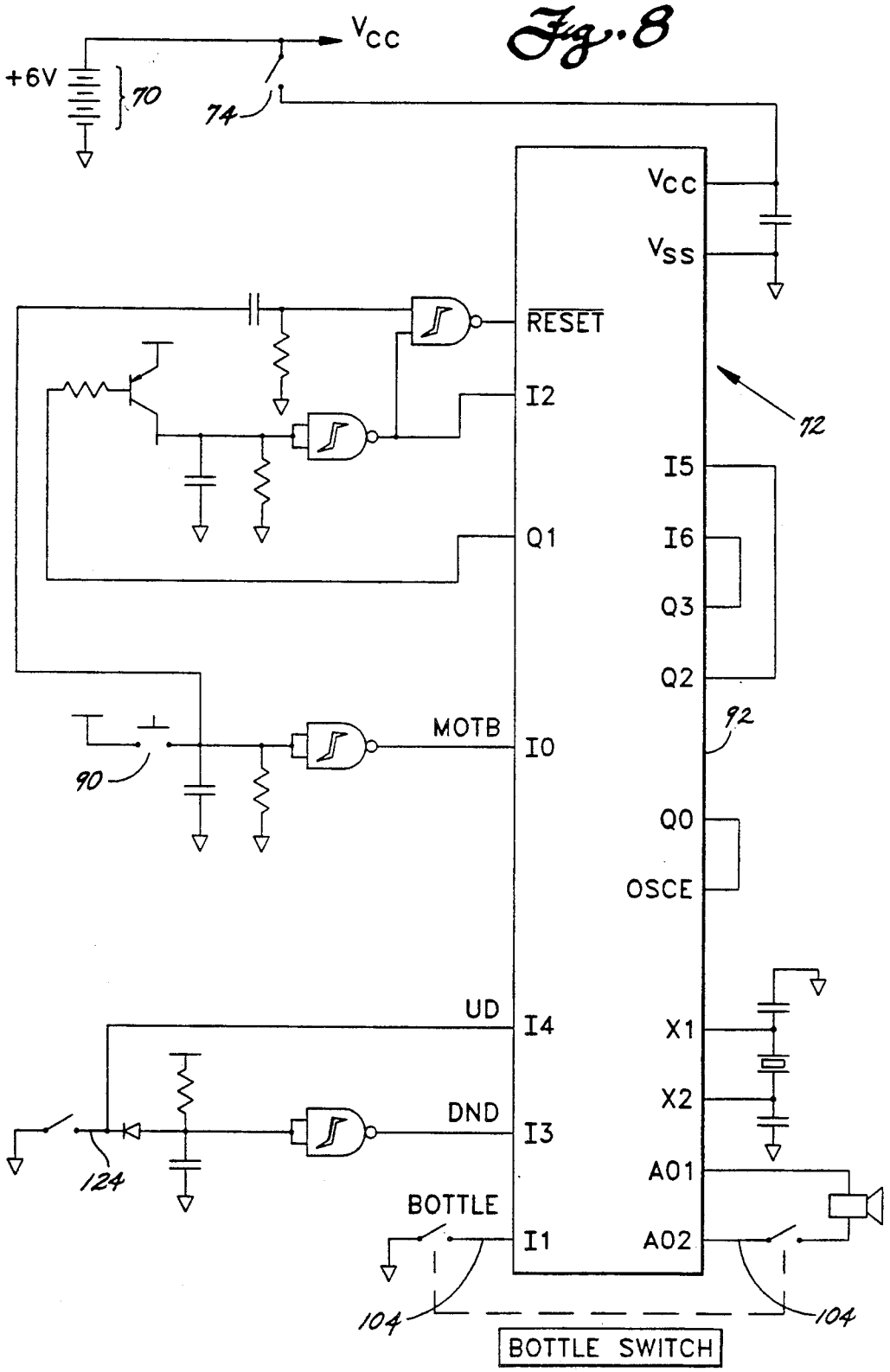
FIG. 8 is an electrical schematic illustrating a preferred construction of the electronic means incorporated in the doll.
Figure 9:
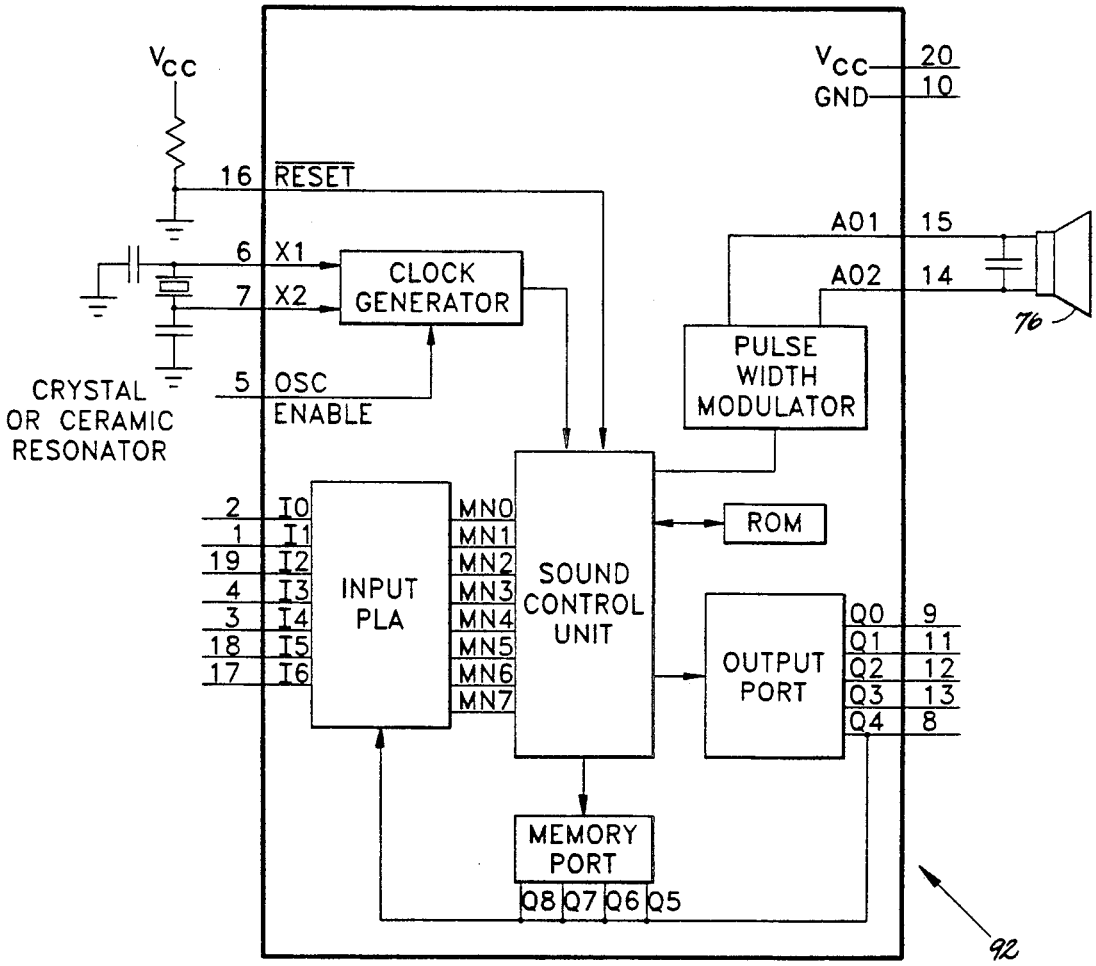
FIG. 9 is a block diagram of the preferred construction of integrated circuit incorporated in the electronic means shown in FIG. 8.

The presently preferred electronic circuit assembly 72 is schematically illustrated in FIG. 8. It incorporates an integrated circuit (IC) which is shown, in block diagram form, in FIG. 9. In general, in its preferred form the integrated circuit is a circuit such as presently offered by Electronic Speech Systems (ESS) of Emeryville, Calif.; as its circuit E03016. It is understood that this circuit is further described in U.S. Pat. No. 4,284,170 to Mozer et al, which patent issued on May 17, 1983. That integrated circuit is believed to incorporate a sound control unit to respond to various input stimuli and to call upon various sequences of electronic information stored in a memory incorporated in the circuit to produce an audio signal that may be applied to a speaker, such as speaker 76, all as more fully described in the aforementioned patent. As programmed by ESS, the presently preferred form of this integrated circuit will produce, in response to various stimuli, sounds selected from a sound vocabulary that including three different laughs, one simulating the crying of an infant, an "ooh" sound, and a "mama" sound. Thus, in its preferred construction the interactive doll system of the present invention is capable of providing the child with at least seven different and distinct sounds.

The electronic circuitry may be turned on and off by switch 74 received in a socket provided in the back of the torso 14. When on, electrical power is conducted from the batteries in battery compartment 70 to the integrated circuit shown in FIG. 8.

The doll also includes a motion sensor or switch 82. In its presently preferred configuration, this motion sensor is a pendulum type switch that responds to any significant motion of the doll beyond that resulting, for example, from a quiet feeding operation, to apply a pulse to the electronic circuit 72. Of course, any other type of motion sensor switch could be employed.

In its presently preferred form, the electronic circuit assembly incorporates a switch circuit 90 that is triggered by motion of the doll (beyond some minimal jiggling) to initiate a sequence of operations of the electronic circuit assembly. This motion sensor and its associated circuit is such that if the doll is not moved for approximately 100 seconds the doll will enter a "sleep" state; switch 90 will reopen to return the electronic circuit assembly to a quiescent but powered up state. In this state, the energy of the batteries in compartment 70 is conserved; it is not consumed by the all various active elements of the circuit.

Thereafter, picking up the doll will "awake" it. The electronic circuitry of the doll will be actuated by the motion sensor 82, and cause the integrated circuit 92 to first produce a sound that is inaudible then to randomly produce one of three different laughs, the particular laugh being selected at random. It also clears a "fed" flag within the IC 92.

Figure 10:
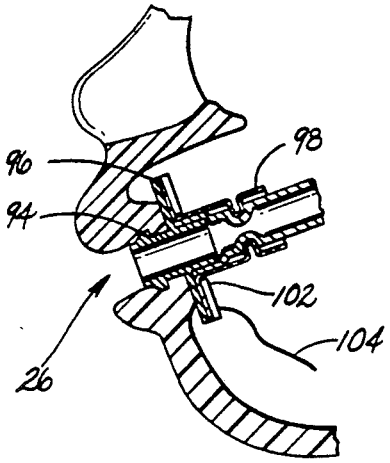
FIG. 10 is a partial view of the mouth area of the preferred construction of doll, in vertical cross-section.

If the child, as it is playing with the doll, places the nipple 28 of bottle 30 within mouth 26 of the doll, shown in cross-section in FIG. 10, as the child pushes nipple 28 into the mouth a tubular member 94 will be pushed back within the mouth causing a collar 96 adjacent its rear end to press a copper flange of fitting 98 against a contact 102, thereby completing the circuit through line 104 that is in turn connected to the electronic circuit assembly 72. The circuit responds to this connection, to inhibit any further production of sound until the nipple is pulled from mouth 26, permitting tubular member 94 to return to its normal position in which collar 96 is spaced from contact 102 and circuit 104 is open. When this occurs, the IC sets an electronic flag indicating that the baby has been fed.

Figure 11:
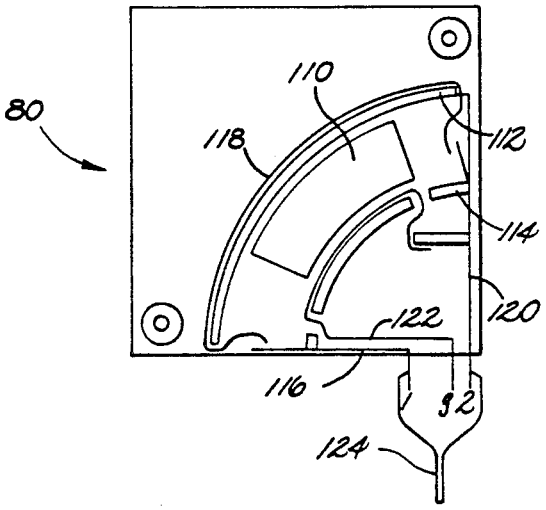
FIG. 11 is a cross-sectional view of the attitude switch incorporated in the present preferred dolls of the invention.

Means are also provided to sense the orientation of the doll. Specifically, the doll includes an attitude switch 80 illustrated in greater detail in FIG. 11. It incorporates a weight 110 riding within a channel defined by continuous wall 112 and a broken wall 114. Threaded about these walls and the channel are various copper strips, including a copper strip 116 that extends to a position at one end of the channel, and underlies an arcuate end of strip 118. Strip 118 extends from a position adjacent strip 116 over the back of continuous wall 112 to its other end. It includes a tab or contact 119 that projects beyond the housing of switch 80. Strip 118, at its upper end turns to again provide an arcuate segment within the channel confining the weight. Under that arcuate segment is a strip 120 that extends down the side wall of the switch's housing and to a position external the switch adjacent the external termination of strip 116. Between strips 116 and 120 is a strip 122 that, in general, is formed to arc over the mid segment of wall 114, generally as shown.

Attitude switch 80 is positioned within the doll such that, when the doll is moved to an orientation of at least 75 degrees, the weight bears upon the segments of strips 116 and 118 lying within the lower end of the channel, to connect strip 116 to strip 118, whereas when the doll is moved to at least 120 degrees the other end of the weight bears upon the arcuate segment of strip 118 and connects it through the arcuate segment to the end portion of strip 120, thereby connecting strip 118 to strip 120. Wires pass from the external end portions or tabs of these strips down electrical conductor 124 to the electronic circuit assembly 72.

If the "fed" electronic flag has been set by closure of the switch adjacent the baby's mouth, and if the doll is tilted up, as indicated by the attitude switch 80, the circuit will enter a crying sequence. In the crying sequence, four successive crying segments are generated, separated by three one second intervals of silence. If during the crying sequence the position of the doll is changed, resulting in a change in the attitude switch 80, the sequence will stop at the next silence interval. If, after being fed, the doll is turned to a vertical position the crying sequence is inhibited for approximately ten seconds. If the motion switch 82 is triggered during that ten second window, as for example by patting the doll on its back a few times, the circuit will cause the audio system to produce a "burp" sound.

After being fed and either burped or left in a position other than one which stimulates the crying sequence, movement of the doll as detected by motion switch 82 will randomly produce any one of the seven sounds from the sound vocabulary previously discussed.

Thus, in this fashion the interactive doll system of the present invention both responds to various actions of the child, calling to the child to be fed, to cry, to cry with both sounds and tears, to wet, to burp, to laugh, to "ooh," and to voice a sound simulating "mama." It will do this not only in response to certain actions of the child but also in response to simply being moved, thereby to produce any one of seven sounds, one of which is the crying sequence previously described.

While a preferred embodiment of the present invention has been illustrated and described, it will be apparent to those skilled in this art that various modifications may be made in the construction and operation of the doll. For that reason, the invention should not be limited to the preferred embodiment described, but rather is as set forth in the following claims.

We claim:

1. A doll having, in combination:

a hollow body with an anal orifice, a hollow head with eyes and an open mouth therein, means connecting the head to the body, a head reservoir for liquid, means mounting the head reservoir within the head, position sensitive feeding means for conducting a liquid from the mouth to the head reservoir only when the doll is oriented in a first range of positions, position sensitive tearing means for conducting liquid from the head reservoir to the eyes only when the doll is oriented in a second range of positions different from the first range;

a body reservoir for liquid, means mounting the body reservoir within the hollow body of the doll, position sensitive means for conducting liquid from the head reservoir to the body reservoir only when the doll is oriented in a certain range of positions; and position sensitive wetting means for conducting liquid from the body reservoir to the anal opening only when the doll is oriented in a third range of positions different from the first two ranges of position.

2. A doll as set forth in claim 1 including electronic means mounted within the doll responsive to at least one of said position sensitive means for producing sounds.

3. A doll as set forth in claim 2 in which the electronic means includes means for producing various infant sounds, including crying sounds;

the electronic means further including means for sensing the application of liquid to the feeding means and for inhibiting production of crying sounds by the electronic means, means for sensing cessation of the application of liquid to the feeding means and for enabling the production of crying sounds by the electronic means; and motion sensitive means for controlling the initiation of crying sounds by the electronic means.

4. A doll as set forth in claim 3 in which the electronic means includes attitude sensing means within the doll for enabling the production of certain sounds only when the doll is in a certain range of attitudes.

5. A doll as set forth in claim 4 in which the electronic means also includes means cycling the electronic means between a power up condition and a power down condition in response to a lack of movement of the doll, as signaled by the motion sensitive means, for a predetermined interval.

6. A doll as set forth in claim 5, in which, when the electronic means is in a power down condition, motion of the doll as signaled by the motion sensitive means causes the electronic system to be in a power up condition.

7. A doll as set forth in claim 1 including means to limit the flow of tears from said eyes.

8. A doll as set forth in claim 1 in which the doll is movable through a range of positions as determined by the main longitudinal axis of the doll defined by a line extending from the top of the doll's head to the bottom of the doll's torso, the angle of 0 degrees being defined by the doll lying in a horizontal plane and facing up, the angle of 90 degrees being defined by the doll being in a vertical position and facing forward, and the angle of 180 degrees as being defined by the doll being in a horizontal position facing down, first range of positions extending from approximately 25 degrees to 35 degrees above the horizontal, said second range of positions extending from approximately 75 degrees to approximately 120 degrees; and said third range of positions extending from approximately 0 degrees to approximately 20 degrees.

* * * * *